US010233631B2

(12) United States Patent
Bates et al.

(10) Patent No.: US 10,233,631 B2
(45) Date of Patent: Mar. 19, 2019

(54) PANEL JUNCTION ATTACHMENTS FOR USE IN A STRUCTURE WITH INTEGRATED INSULATION

(71) Applicants: Steve Bates, Draper, UT (US); Dee Bates, Draper, UT (US)

(72) Inventors: Steve Bates, Draper, UT (US); Dee Bates, Draper, UT (US)

( * ) Notice: Subject to any disclaimer, the term of this patent is extended or adjusted under 35 U.S.C. 154(b) by 0 days.

(21) Appl. No.: 15/302,161

(22) PCT Filed: Feb. 5, 2015

(86) PCT No.: PCT/IB2015/050890
§ 371 (c)(1),
(2) Date: Oct. 5, 2016

(87) PCT Pub. No.: WO2015/118485
PCT Pub. Date: Aug. 13, 2015

(65) Prior Publication Data

US 2017/0073956 A1 Mar. 16, 2017

Related U.S. Application Data

(63) Continuation of application No. 14/173,703, filed on Feb. 5, 2014, and a continuation of application No.
(Continued)

(51) Int. Cl.
*E04B 1/24* (2006.01)
*E04C 3/292* (2006.01)
(Continued)

(52) U.S. Cl.
CPC ..... *E04B 1/24* (2013.01); *E04C 3/292* (2013.01); *E04B 2/82* (2013.01); *E04B 5/10* (2013.01);
(Continued)

(58) Field of Classification Search
CPC ..... E04B 1/14; E04B 1/24; E04B 2/82; E04B 5/10; E04B 7/00; E04B 2001/2415;
(Continued)

(56) References Cited

U.S. PATENT DOCUMENTS 2,915,150 A * 12/1959 Weidler ..... E02D 17/04 52/269
3,196,499 A * 7/1965 Houvener ..... E04B 1/14 52/272

(Continued)

*Primary Examiner* — James M Ference
(74) *Attorney, Agent, or Firm* — Dodd Call Black, PLLC; Dustin Call

(57) ABSTRACT

A structure with integrated insulation. The structure with integrated insulation includes a steel frame. The steel frame includes a first support beam and a second support beam. The structure with integrated insulation also includes an assembly with integrated insulation. The assembly with integrated insulation includes a first building panel with integrated insulation, the first building panel with integrated insulation being attached to the first support beam on the first surface of the first building panel with integrated insulation. The assembly with integrated insulation also includes a second building panel with integrated insulation. The second building panel with integrated insulation 4 includes an indentation in the first surface configured to receive at least a portion of the first building panel with integrated insulation. The second building panel with integrated insulation being attached to the second support beam on the second surface of the second building panel with integrated insulation.

20 Claims, 16 Drawing Sheets

Related U.S. Application Data

14/173,696, filed on Feb. 5, 2014, and a continuation of application No. 14/173,721, filed on Feb. 5, 2014, and a continuation of application No. 14/173,713, filed on Feb. 5, 2014.

(51) Int. Cl.

| | |
|---|---|
| *E04B 2/82* | (2006.01) |
| *E04C 3/04* | (2006.01) |
| *E04C 3/07* | (2006.01) |
| *E04B 5/10* | (2006.01) |
| *E04B 7/00* | (2006.01) |

(52) U.S. Cl.

CPC ..... *E04B 7/00* (2013.01); *E04B 2001/2415* (2013.01); *E04B 2001/2448* (2013.01); *E04B 2001/2466* (2013.01); *E04B 2001/2481* (2013.01); *E04B 2103/06* (2013.01); *E04C 3/07* (2013.01); *E04C 2003/046* (2013.01); *E04C 2003/0452* (2013.01); *E04C 2003/0473* (2013.01)

(58) Field of Classification Search

CPC ..... E04B 2001/2448; E04B 2001/2466; E04B 2001/2481; E04B 2103/06; E04C 2/292; E04C 2/296; E04C 3/07; E04C 3/292; E04C 2003/0452; E04C 2003/046; E04C 2003/0473; E04D 3/352; E04D 3/355

USPC ..... 52/274, 309.7, 309.16, 309.11, 309.9, 52/793.1, 794.1, 293.1, 404.1

See application file for complete search history.

(56) References Cited

U.S. PATENT DOCUMENTS 3,386,218 A * 6/1968 Scott ..... E04B 1/6803 52/309.11
3,436,881 A * 4/1969 Schlecht ..... E04B 1/6112 52/282.1
3,830,027 A * 8/1974 Paisley ..... E04B 2/825 52/211
4,051,641 A * 10/1977 Elliott ..... E04B 1/24 52/282.3
4,143,498 A * 3/1979 Martin, Jr. ..... E04F 13/0846 52/506.1
4,195,459 A * 4/1980 Anderson ..... E04B 2/92 52/309.9
4,372,901 A * 2/1983 Kim ..... B29C 44/18 264/261
4,571,909 A * 2/1986 Berghuis ..... E04B 1/76 52/309.11
4,769,963 A * 9/1988 Meyerson ..... E04B 1/80 52/309.9
5,014,476 A * 5/1991 Leslie ..... E04B 1/6162 52/220.2
5,509,242 A * 4/1996 Rechsteiner ..... E04B 1/14 52/220.2
5,743,056 A * 4/1998 Balla-Goddard ..... E04B 1/14 52/127.9
6,256,960 B1 * 7/2001 Babcock ..... E04B 1/14 52/281
6,279,287 B1 * 8/2001 Meadows ..... E04C 2/292 52/309.9
6,298,619 B1 * 10/2001 Davie ..... E04B 1/14 52/220.7
6,481,172 B1 * 11/2002 Porter ..... B32B 5/18 428/317.7
6,584,740 B2 * 7/2003 Record ..... E04B 1/14 52/270
6,627,128 B1 * 9/2003 Boyer ..... E04C 2/292 264/46.5
8,161,706 B2 * 4/2012 Gingras ..... E04B 1/14 52/284
8,756,889 B2 * 6/2014 LeBlang ..... E04B 1/80 52/252
9,493,947 B2 * 11/2016 McClure ..... E04C 2/46
2002/0069600 A1 * 6/2002 Bryant ..... E04B 1/12 52/309.9
2004/0103601 A1 * 6/2004 Bergqvist ..... E02D 5/801 52/284
2004/0134162 A1 * 7/2004 Douglas ..... E02D 27/02 52/741.1
2006/0037155 A1 * 2/2006 Szekely ..... E01F 1/00 14/69.5
2006/0096204 A1 * 5/2006 Martens ..... E02D 27/02 52/293.3
2007/0125042 A1 * 6/2007 Hughes ..... B32B 5/18 52/782.1
2011/0179722 A1 * 7/2011 Schulz ..... E04B 1/34315 52/79.1
2011/0197530 A1 * 8/2011 Bahnmiller ..... B32B 5/14 52/309.4
2013/0000223 A1 * 1/2013 Hill ..... E04B 1/26 52/105
2013/0305643 A1 * 11/2013 Singleton ..... E04C 2/284 52/309.8
2015/0047281 A1 * 2/2015 Cole ..... E04F 13/148 52/302.1
2016/0194864 A1 * 7/2016 Walker ..... E04B 1/40 52/745.06
2017/0218637 A1 * 8/2017 Cole ..... E04F 13/0878
2018/0044922 A1 * 2/2018 Cole ..... B32B 5/32

* cited by examiner

PANEL JUNCTION ATTACHMENTS FOR USE IN A STRUCTURE WITH INTEGRATED INSULATION

CROSS-REFERENCE TO RELATED APPLICATIONS

This application claims the benefit of and priority to U.S. Non-Provisional patent application Ser. No. 14/173,713 filed on Feb. 5, 2015, which application is incorporated herein by reference in its entirety.

This application claims the benefit of and priority to U.S. Non-Provisional patent application Ser. No. 14/173,696 filed on Feb. 5, 2015, which application is incorporated herein by reference in its entirety (hereinafter "first related application").

This application claims the benefit of and priority to U.S. Non-Provisional patent application Ser. No. 14/173,703 filed on Feb. 5, 2015, which application is incorporated herein by reference in its entirety (hereinafter "second related application").

This application claims the benefit of and priority to U.S. Non-Provisional patent application Ser. No. 14/173,721 filed on Feb. 5, 2015, which application is incorporated herein by reference in its entirety (hereinafter "third related application").

BACKGROUND OF THE INVENTION

Pre-fabricated buildings offer a number of conveniences. For example, because they use manufactured materials (such as metals), the amount of waste is often reduced relative to on-site building projects. This helps to reduce the cost for the consumer. In addition, pre-fabricated buildings install quickly, sometimes within a few hours. This allows them to be put up when an immediate need arises. For example, they can act as temporary housing or storage while a more permanent structure is constructed. They can then be moved, in some cases, to a new location.

Nevertheless, pre-fabricated buildings suffer from a number of drawbacks. For example, they are mass produced, reducing the ability of the consumer to design a building specifically for his/her needs. Moreover, they are more difficult to customize after the fact. In particular, they often do not have walls or other locations where materials can be attached or hung. This means that customization is often a more labor intensive process.

In addition, pre-fabricated buildings often are less energy efficient than other buildings. I.e., because the pieces are made to fit together quickly, there are often gaps or other areas that allow air to either enter or exit the building. This makes the building more difficult to heat or cool and to prevent drafts. Also, they may be made of sheet metal or other materials that act as good thermal conductors, allowing heat transfer into or out of the conditioned space. This means that the heat or air conditioning is often set to a more extreme temperature as users try to ensure a comfortable space.

Finally, pre-fabricated buildings are often not as sturdy as other buildings. For example, they may be made of sheet metal or plywood. Therefore, they are often used only as temporary buildings and more permanent structures must be built if the disadvantages outweigh the advantages.

Accordingly, there is a need in the art for a pre-fabricated building that can be customized to the needs of the user, both in the design and building process and after installation is complete. Further, there is a need in the art for the pre-fabricated building to be energy efficient, both by reducing thermal conductivity and by eliminating any gaps. Moreover, there is a need for the pre-fabricated building to be sturdy enough to act as a permanent structure, if so desired.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a structure with integrated insulation. The structure with integrated insulation includes a steel frame. The steel frame includes a first support beam and a second support beam. The structure with integrated insulation also includes an assembly with integrated insulation. The assembly with integrated insulation includes a first building panel with integrated insulation. The building panel with integrated insulation includes a first surface, a second surface, wherein the second surface is opposite the first surface, a first edge, wherein the first edge is disposed between the first surface and the second surface and a second edge, wherein the second edge is disposed between the first surface and the second surface and is opposite the first edge. The first building panel with integrated insulation being attached to the first support beam on the first surface of the first building panel with integrated insulation, wherein the attachment between the first support beam and the first building panel with integrated insulation includes adhesive over the entirety of a web of the first support beam in contact with the first building panel with integrated insulation. The assembly with integrated insulation also includes a second building panel with integrated insulation. The second building panel with integrated insulation includes a first surface, a second surface, wherein the second surface is opposite the first surface, a first edge, wherein the first edge is disposed between the first surface and the second surface and a second edge, wherein the second edge is disposed between the first surface and the second surface and is opposite the first edge. The second building panel with integrated insulation also includes an indentation in the first surface configured to receive at least a portion of the first building panel with integrated insulation. The second building panel with integrated insulation being attached to the second support beam on the second surface of the second building panel with integrated insulation, wherein the attachment between the second support beam and the second building panel with integrated insulation includes adhesive over the entirety of a web of the second support beam in contact with the second building panel with integrated insulation.

Another example embodiment includes a structure with integrated insulation. The structure with integrated insulation includes a steel frame. The steel frame includes a first support beam and a second support beam. The structure with integrated insulation also includes an assembly with integrated insulation. The assembly with integrated insulation includes a first building panel with integrated insulation. The building panel with integrated insulation includes a first surface, a second surface, wherein the second surface is opposite the first surface, a first edge, wherein the first edge is disposed between the first surface and the second surface and a second edge, wherein the second edge is disposed between the first surface and the second surface and is opposite the first edge. The first building panel with integrated insulation being attached to the first support beam on the first surface of the first building panel with integrated insulation, wherein the attachment between the first support beam and the first building panel with integrated insulation includes adhesive over the entirety of a web of the first support beam in contact with the first building panel with integrated insulation. The assembly with integrated insulation also includes a second building panel with integrated insulation. The second building panel with integrated insulation includes a first surface, a second surface, wherein the second surface is opposite the first surface, a first edge, wherein the first edge is disposed between the first surface and the second surface and a second edge, wherein the second edge is disposed between the first surface and the second surface and is opposite the first edge. The second building panel with integrated insulation also includes an indentation in the first surface configured to receive at least a portion of the first building panel with integrated insulation. The second building panel with integrated insulation also includes a c-channel attached within the indentation, wherein the c-channel is configured receive the first edge of the first building panel with integrated insulation. The c-channel includes adhesive on the entire surface of the c-channel in contact with the second building panel with integrated insulation. The second building panel with integrated insulation being attached to the second support beam on the second surface of the second building panel with integrated insulation, wherein the attachment between the second support beam and the second building panel with integrated insulation includes adhesive over the entirety of a web of the second support beam in contact with the second building panel with integrated insulation.

Another example embodiment includes a structure with integrated insulation. The structure with integrated insulation includes a steel frame. The steel frame includes a first support beam and a second support beam. The structure with integrated insulation also includes an assembly with integrated insulation. The assembly with integrated insulation includes a first building panel with integrated insulation. The building panel with integrated insulation includes a first surface, a second surface, wherein the second surface is opposite the first surface, a first edge, wherein the first edge is disposed between the first surface and the second surface and a second edge, wherein the second edge is disposed between the first surface and the second surface and is opposite the first edge. The first building panel with integrated insulation being attached to the first support beam on the first surface of the first building panel with integrated insulation, wherein the attachment between the first support beam and the first building panel with integrated insulation includes adhesive over the entirety of a web of the first support beam in contact with the first building panel with integrated insulation. The assembly with integrated insulation also includes a second building panel with integrated insulation. The second building panel with integrated insulation includes a first surface, a second surface, wherein the second surface is opposite the first surface, a first edge, wherein the first edge is disposed between the first surface and the second surface and a second edge, wherein the second edge is disposed between the first surface and the second surface and is opposite the first edge. The second building panel with integrated insulation also includes an indentation in the first surface configured to receive at least a portion of the first building panel with integrated insulation. The second building panel with integrated insulation also includes a c-channel attached within the indentation, wherein the c-channel is configured receive the first edge of the first building panel with integrated insulation. The c-channel includes adhesive on the entire surface of the c-channel in contact with the second building panel with integrated insulation. The second building panel with integrated insulation being attached to the second support beam on the second surface of the second building panel with integrated insulation, wherein the attachment between the second support beam and the second building panel with integrated insulation includes adhesive over the entirety of a web of the second support beam in contact with the second building panel with integrated insulation. The structure with integrated insulation additionally includes a backing secured within the second building panel with integrated insulation, the backing configured to allow an external device to be attached to the second building panel with integrated insulation.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
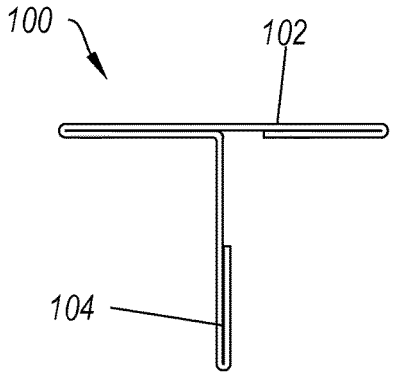
FIG. 1A illustrates an example of a T-beam for use with an interior wall.
Figure 1B:
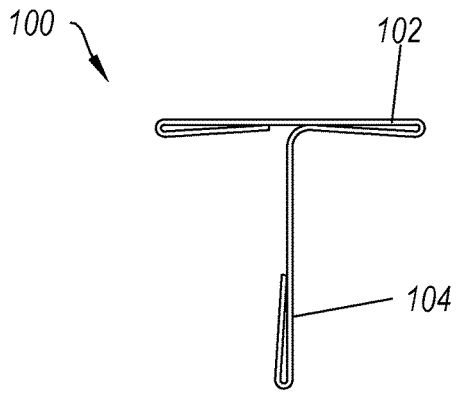
FIG. 1B illustrates an example of a T-beam for use with an exterior wall.

FIGS. 1A and 1B (collectively "FIG. 1") show a T-beam 100. FIG. 1A illustrates an example of a T-beam 100 for use with an interior wall; and FIG. 1B illustrates an example of a T-beam 100 for use with an exterior wall. The T-beam 100 is a load-bearing structure with a "T" shaped cross section. The T-beam 100 can be used to support a wall panel (as described in first related application). The T-beam 100 can be made of any desired material including wood, steel, aluminum or any other desired material. Additionally or alternatively, the installation pattern of the T-beam 100 can create a thermal break (as described in third related application).

FIG. 1 shows that the T-beam 100 can include a flange 102. The flange 102 remains outside of the wall panel, acting as a frame. The flange 102 (the horizontal portion when viewed as a "T") serves as a compression member in resisting compressive stresses. I.e., the flange 102 supplies a vertical "holding" force within the structure frame. The flange 102 can be approximately 2 inches wide. As used in the specification and the claims, the term approximately shall mean that the value is within 10% of the stated value, unless otherwise specified.

FIG. 1 also shows that the T-beam 100 can include a web 104. The web 104 (the vertical portion when viewed as a "T) serves to resist shear stress and to provide greater separation for the coupled forces of bending. The web 104 can be approximately 2 inches tall for use with an exterior wall panel and approximately 1.5 inches tall for use with an interior wall panel.

By way of example, a method of creating the T-beam 100 is described herein. The T-beam 100 starts out as a flat sheet of 20 gage steel (standard). Flange 102 is approximately two inches wide. To make flange 102 there will be two 180 degree bends, one on each end of the flange 102 and one (1) 180 degree bend on the bottom of the web 104. The first bend at the bottom of the top right side of the flange 102 is a one hundred and eighty (180) degree bend that is approximately seven eights (⅞") of an inch that goes back to the center of the of flange 102. The second bend is at the left of the flange 102. This one hundred and eighty (180) degree bend is one (1") inch in length and goes back to the center of the T-beam 100. At the end of this one (1") inch bend will be a ninety (90) degree bend that is one and one half (1½") inches (2 inches for an exterior wall) in length to create the web 104. At the end of the one and one half (1½") inch web 104 on the T will be another one hundred and eighty (180) degree bend that will be one quarter (¼") of an inch in length.

Figure 2A:
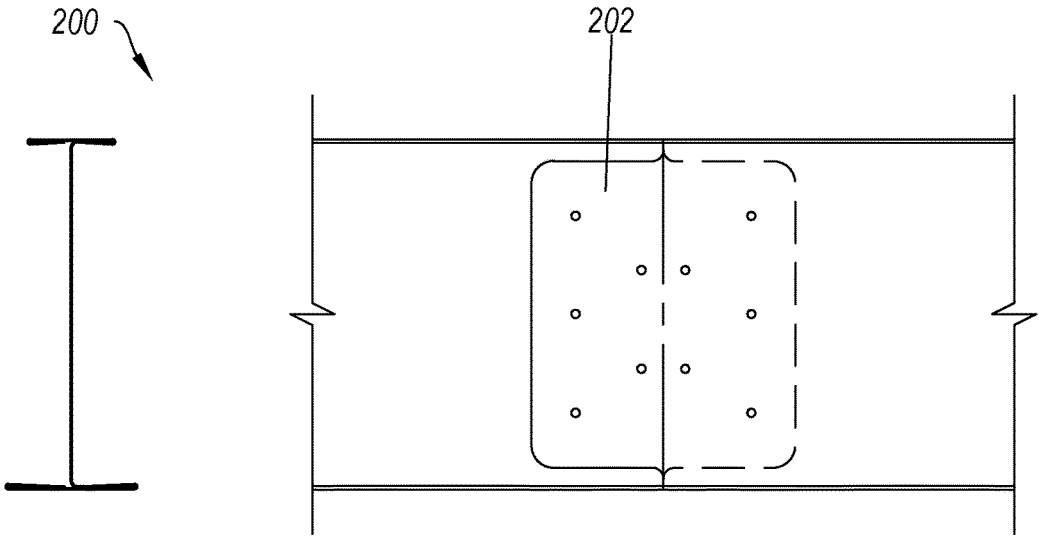
FIG. 2A illustrates an example of a connection between I-beams which are in line relative to one another.
Figure 2B:
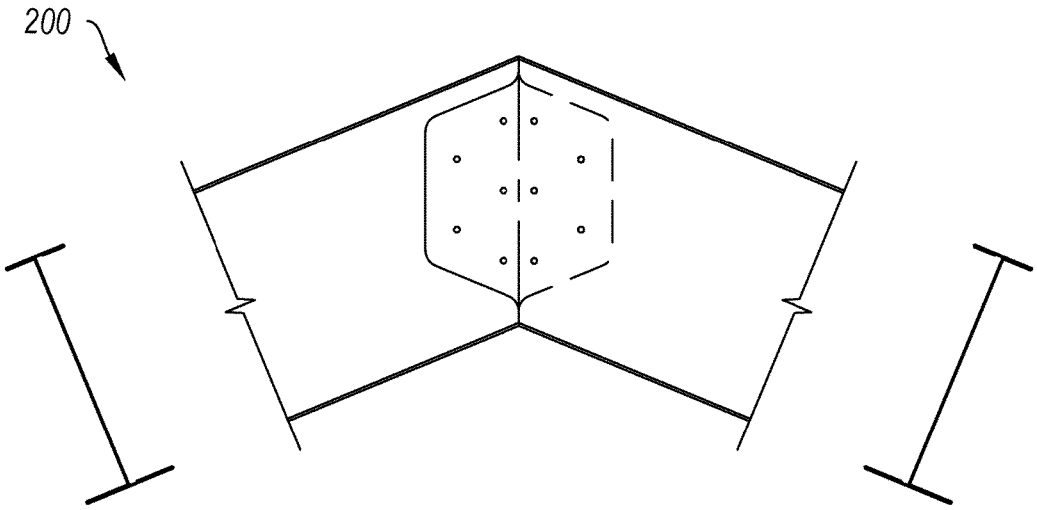
FIG. 2B illustrates an example of a connection between I-beams which are not in line relative to one another.

FIGS. 2A and 2B (collectively "FIG. 2") illustrate an example of a connection 200 between I-beams. FIG. 2A illustrates an example of a connection 200 between I-beams which are in line relative to one another; and FIG. 2B illustrates an example of a connection 200 between I-beams which are not in line relative to one another. An I-beam, also known as H-beam, W-beam (for "wide flange"), Universal Beam (UB), Rolled Steel Joist (RSJ), or double-T (especially in Polish, Bulgarian, Spanish, Italian and German), is a beam with an I- or H-shaped cross-section. The horizontal elements of the "I" are flanges, while the vertical element is termed the web. The I-shaped section is a very efficient form for carrying both bending and shear loads in the plane of the web.

FIG. 2 shows that the connection 200 includes a plate 202. The plate 202 is a piece of structural steel or other material. The plate 202 is configured to be secured to each of the I-beams which secures the I-beams relative to one another. I.e., the plate 202 is of sufficient size and strength to ensure that the load placed on the intersection of the I-beams is sufficiently secured, as if the gap did not exist. I.e., ideally there is no loss of strength at the intersection secured by the plate 202. Each I-Beam will have four (4) pre drilled holes to attach to the plate 202. A total of eight (8) rivets will be used to secure the two I-Beams together at the ridge line, hips and valleys. As used in the specification and the claims, the phrase "configured to" denotes an actual state of configuration that fundamentally ties recited elements to the physical characteristics of the recited structure. As a result, the phrase "configured to" reaches well beyond merely describing functional language or intended use since the phrase actively recites an actual state of configuration.

Figure 3:
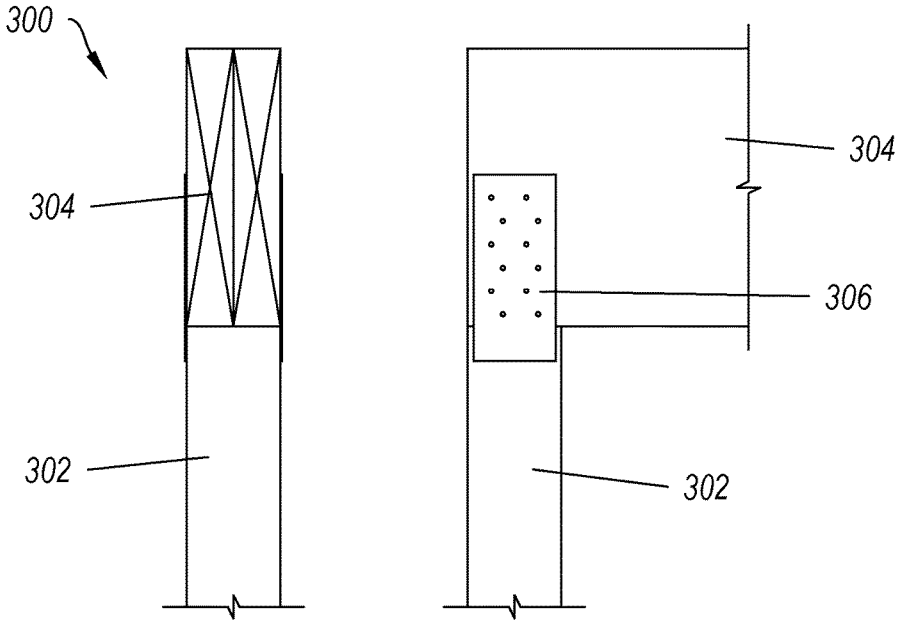
FIG. 3 illustrates an example of a connection between a post and a wooden beam.

FIG. 3 illustrates an example of a connection 300 between a post 302 and a wooden beam 304. The post (as described in second related application) is a structural element that can be attached to the end of a wall panel. The connection 300 allows the post to act as a support for the wooden beam 304. The wooden beam 304 acts to support the elements mounted above the wooden beam 304, such as another floor of the structure, a roof or any other element.

FIG. 3 shows that the connection 300 can include a plate 306. The plate 306 is a piece of structural steel or other material. The plate 306 is configured to be secured to both the post 302 and the wooden beam 304 securing the post 302 and the wooden beam 304 relative to one another. I.e., the plate 306 is of sufficient size and strength to ensure that the post 302 and the wooden beam 304 do not move relative to one another. The plate 306 is attached to the post 302 and the wooden beam 304 using rivets, screws, adhesive or any other desired attachment method.

Figure 4A:
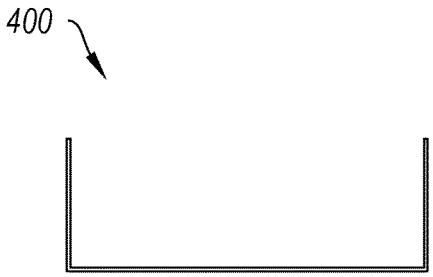
FIG. 4A illustrates a c-channel configured to receive an interior wall panel.
Figure 4B:
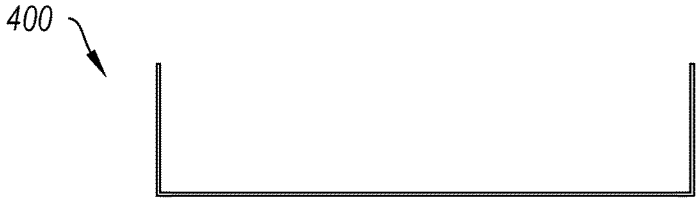
FIG. 4B illustrates a c-channel configured to receive an exterior wall panel.
Figure 4C:
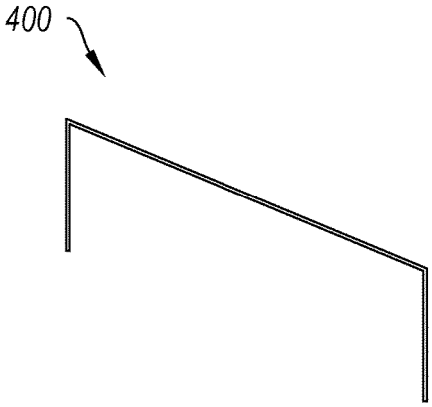
FIG. 4C illustrates an angled c-channel configured to receive an interior wall panel.
Figure 4D:
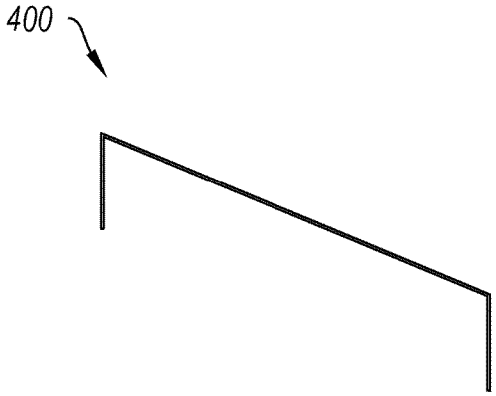
FIG. 4D illustrates an angled c-channel configured to receive an exterior wall panel.
Figure 4E:
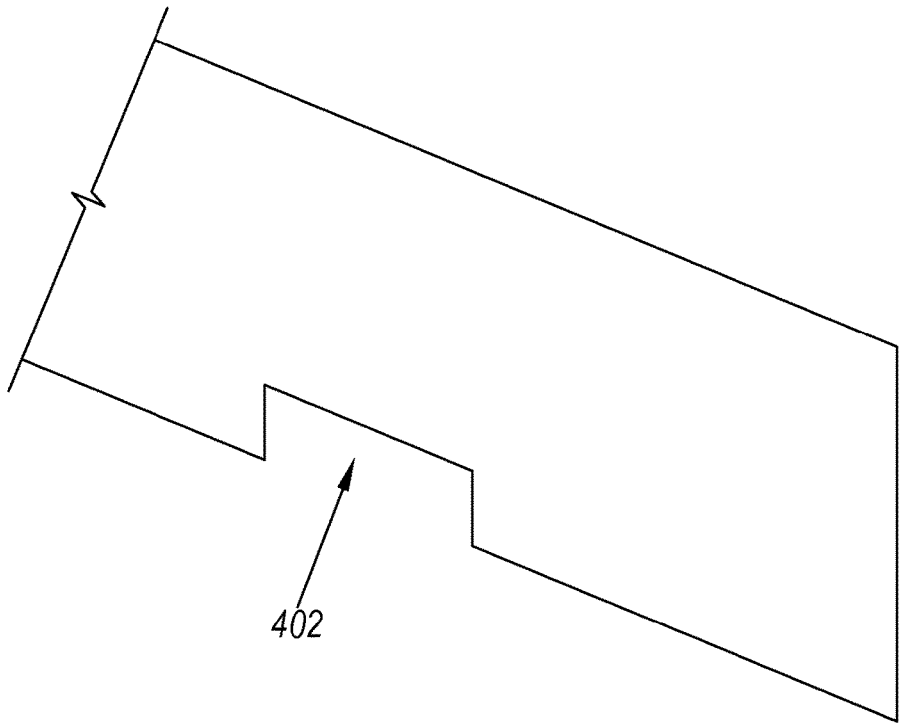
FIG. 4E illustrates an indentation in a roof panel configured to receive an c-channel.

FIGS. 4A, 4B, 4C, 4D, and 4E (collectively "FIG. 4") illustrate an example of a c-channel 400. FIG. 4A illustrates a c-channel 400 configured to receive an interior wall panel; FIG. 4B illustrates a c-channel 400 configured to receive an exterior wall panel; FIG. 4C illustrates an angled c-channel 400 configured to receive an interior wall panel; FIG. 4D illustrates an angled c-channel 400 configured to receive an exterior wall panel; and FIG. 4E illustrates an indentation 402 in a roof panel configured to receive an c-channel 400. The c-channel 400 is a notch or groove that is shaped like a square "C". I.e., it is a parallelogram with one side missing. If desired, the c-channel 400 can include a flange or other retaining mechanism near the open side. I.e., the "missing side" of the parallelogram may be partially missing only in order to better retain an external element within the c-channel 400. The c-channel 400 can receive a wall panel (as described in first related application) or some other structural element. E.g., a wall panel can be inserted into the c-channel 400 and then glued or otherwise permanently attached, creating a connection between the element containing the c-channel 400 and the element inserted into the c-channel 400. The c-channel 400 can include a metal or wood brace. The c-channel 400 can be glued into an indentation 402 cut out from a building panel with integrated insulation and/or attached to a desired element (such as an I-beam, wooden beam) or glued within the c-channel of a building panel with integrated insulation, configured to receive a wall panel.

The height of the c-channel 400 can be critical to create a thermal break (as described in third related application). For example, the c-channel 400 can be approximately 75% of the height of the indentation 402 cut in the building panel with integrated insulation into which the c-channel 400 will be inserted. E.g., if the indentation 402 cut in the building panel with integrated insulation is approximately 2 inches high then the c-channel 400 can be approximately 1.5 inches high. Making the c-channel 400 smaller that the indentation 402 cut in the building panel with integrated insulation can be critical to prevent a thermal bridge that passes through the entire panel.

One of skill in the art will appreciate that the that the "width" of the c-channel 404 will be the horizontal width and which is not necessarily the same as the size of the c-channel 400 as measured along the surface of the containing element, such as a roof panel. For example, the roof's pitch is its vertical rise divided by its horizontal span (or "run"), what is called "slope" in geometry and stair construction, or the tangent function in trigonometry. It is typically expressed with the rise first and run second, with the run denominated by the number 12, giving a ratio of how many inches of incline there is to each foot of run. For example, 3:12, 4:12, 5:12, and so on. To find the exact roof slope in degrees, one takes the arctangent. For example: arctan(3/12)=14.0°. One of skill in the art will appreciate that the measured opening of the c-channel 400 in the roof panel with integrated insulation 110 may not be the exact width of the wall panel. I.e., because the roof panel with integrated insulation 110 may be installed at an angle the measured width along the surface of the roof panel with integrated insulation 110 will be longer than a horizontal measurement at the installed angled. For example, if the roof has a pitch of 6/12 (~26.6 degrees) then the measured opening along the surface of the roof panel with integrated insulation 110 can be calculated by:

$$\frac{w}{\cos(\tan^{-1}(p))} = \frac{w}{\frac{1}{\sqrt{1+p^2}}} = w \times \sqrt{1+p^2}$$

where w is the horizontal width and p is the pitch expressed as a fraction or a decimal. For example, if the pitch is 6/12 then the opening across the surface is $6\times\sqrt{1+(0.5)^2}=6.708$ inches for an exterior wall and 4.472 inches for an interior wall.

Figure 5A:
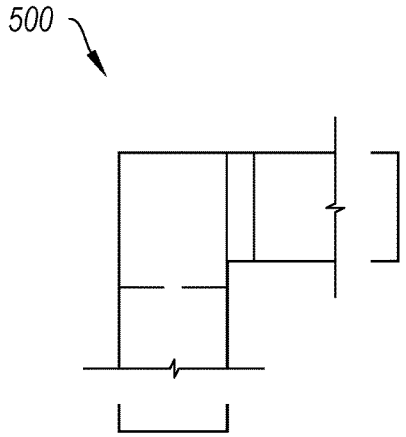
FIG. 5A illustrates an example of a c-channel junction of interior walls forming a corner.
Figure 5B:
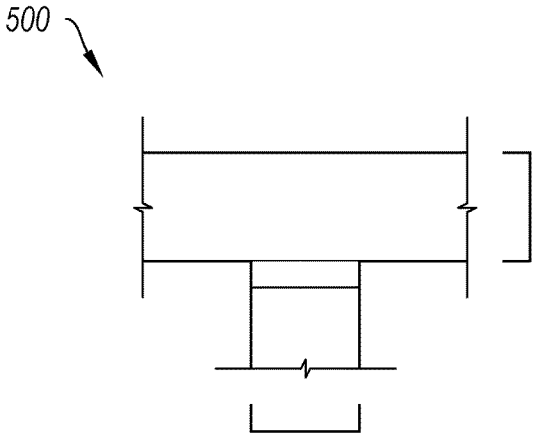
FIG. 5B illustrates an example of a c-channel junction of interior walls forming a T-junction.
Figure 5C:
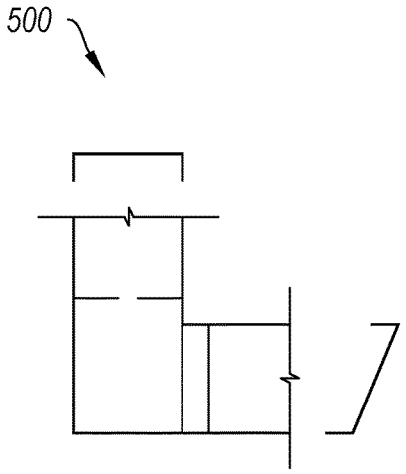
FIG. 5C illustrates an example of a c-channel junction of an interior wall and an exterior wall forming a corner.
Figure 5D:
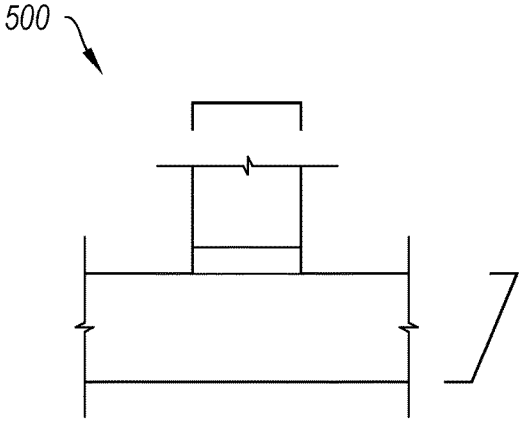
FIG. 5D illustrates an example of a c-channel junction of an interior wall and an exterior wall forming a T-junction.

FIGS. 5A, 5B, 5C and 5D (collectively "FIG. 5") illustrate examples of c-channel junctions 500. FIG. 5A illustrates an example of a c-channel junction 500 of interior walls forming a corner; FIG. 5B illustrates an example of a c-channel junction 500 of interior walls forming a T-junction; FIG. 5C illustrates an example of a c-channel junction 500 of an interior wall and an exterior wall forming a corner; and FIG. 5D illustrates an example of a c-channel junction 500 of an interior wall and an exterior wall forming a T-junction. Because the c-channels 400 are configured to receive an external element, such as a wall panel, there will be places where c-channels 400 meet one another forming a junction. The c-channel junction 500 can either be a corner (i.e., where both walls end) or a T-junction (i.e. one wall ends in the middle of another wall). The c-channel junction 500 is a bracket configured to receive the wall panels at the intersection.

Figure 6A:
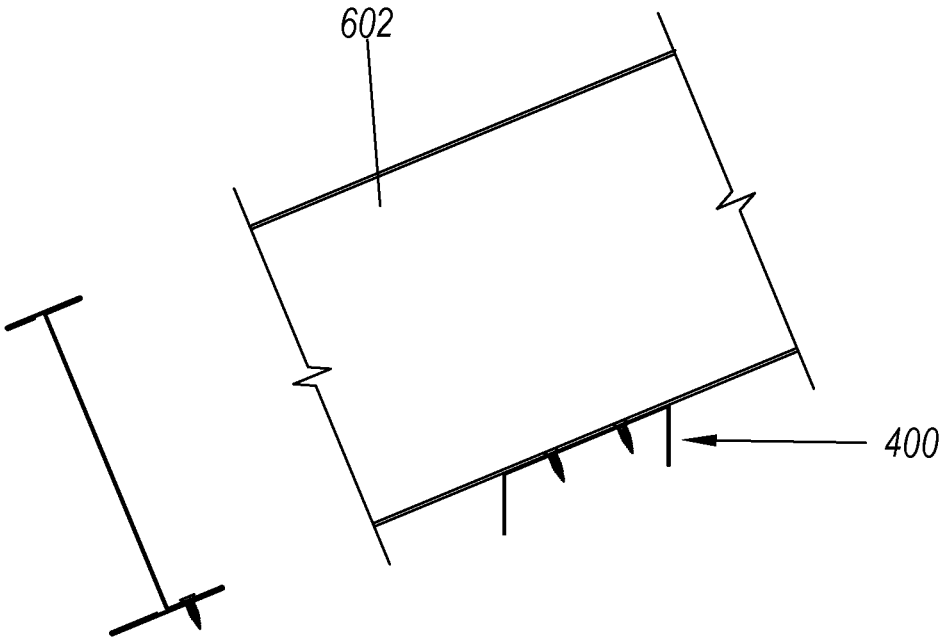
FIG. 6A illustrates an example of an angled c-channel for an interior wall connected to an I-beam.
Figure 6B:
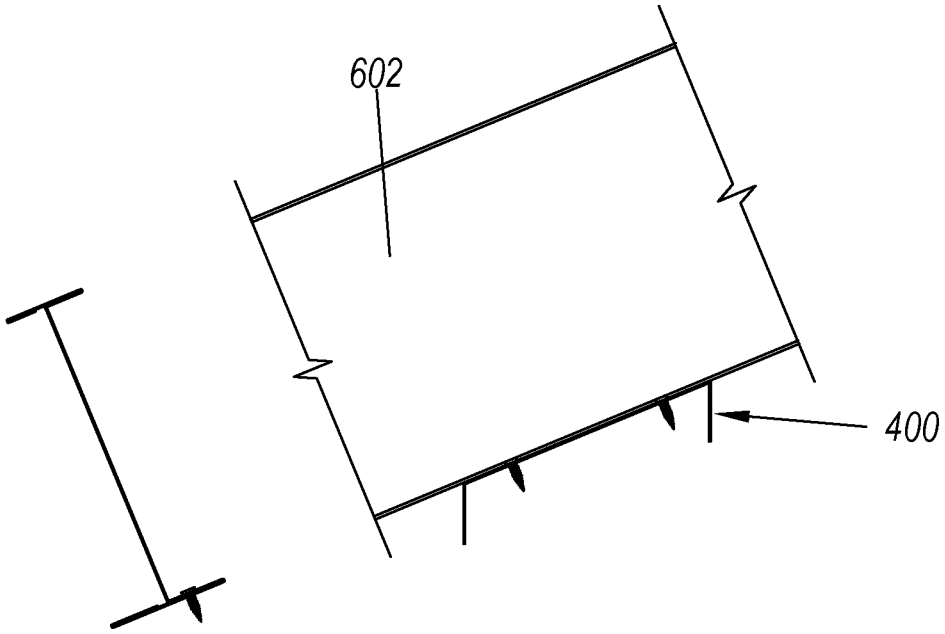
FIG. 6B illustrates an example of an angled c-channel for an exterior wall connected to an I-beam.
Figure 6C:
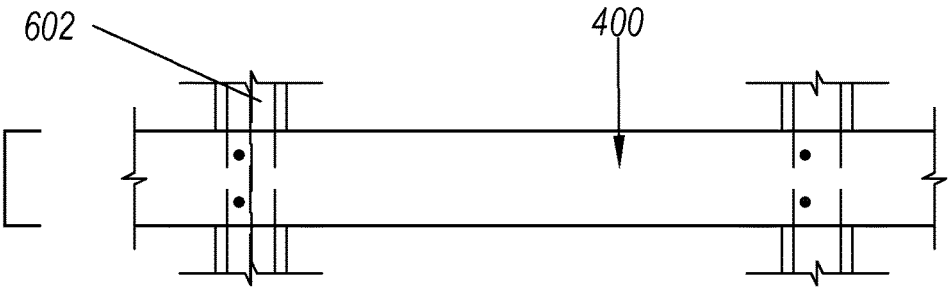
FIG. 6C illustrates an example of a c-channel for an interior wall connected to an I-beam.
Figure 6D:
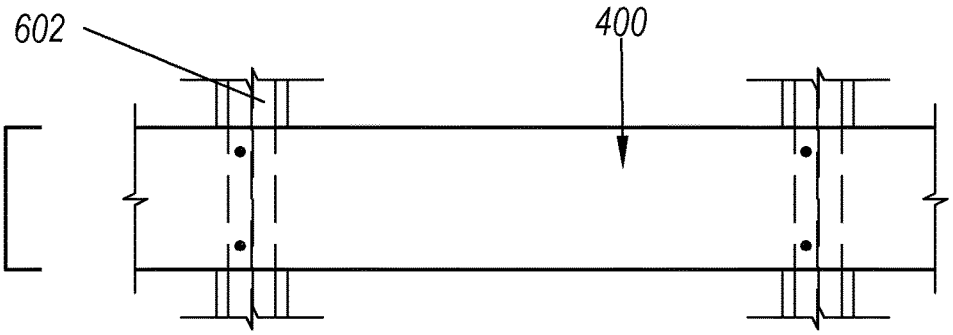
FIG. 6D illustrates an example of a c-channel for an exterior wall connected to an I-beam.
Figure 6E:
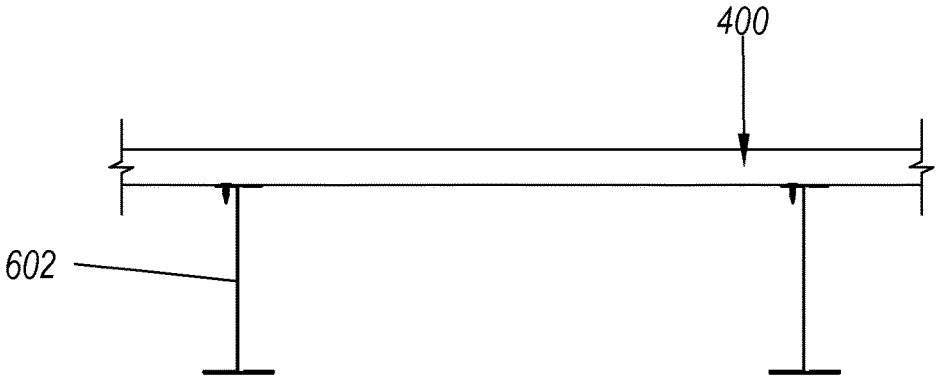
FIG. 6E illustrates a side view of an example of a c-channel (for an interior wall or an exterior wall) connected to an I-beam.

FIGS. 6A, 6B, 6C, 6D and 6E (collectively "FIG. 6") illustrate an example of a c-channel 400 connected to an I-beam 602. FIG. 6A illustrates an example of an angled c-channel 400 for an interior wall connected to an I-beam 602; FIG. 6B illustrates an example of an angled c-channel 400 for an exterior wall connected to an I-beam 602; FIG. 6C illustrates an example of a c-channel 400 for an interior wall connected to an I-beam 602; FIG. 6D illustrates an example of a c-channel 400 for an exterior wall connected to an I-beam 602; and FIG. 6E illustrates a side view of an example of a c-channel 400 (for an interior wall or an exterior wall) connected to an I-beam 602. A c-channel 400 connected to an I-beam 602 allows an I-beam 602 supporting an floor, roof or other structure to receive a wall panel with integrated insulation. I.e., the wall is created and the c-channel 400 can be placed over the wall panels making up the wall, forming an intersection between the wall and floor or roof.

FIG. 6 shows that the c-channel 400 is attached to the flange of the I-beam 602 using a screw, nut and bolt, rivet, weld or other attachment. Rivets are a permanent mechanical fastener. Before being installed a rivet consists of a smooth cylindrical shaft with a head on one end. The end opposite the head is called the buck-tail. On installation the rivet is placed in a punched or drilled hole, and the tail is upset, or bucked (i.e., deformed), so that it expands to about 1.5 times the original shaft diameter, holding the rivet in place. To distinguish between the two ends of the rivet, the original head is called the factory head and the deformed end is called the shop head or buck-tail. Because there is effectively a head on each end of an installed rivet, it can support tension loads (loads parallel to the axis of the shaft); however, it is much more capable of supporting shear loads (loads perpendicular to the axis of the shaft).

Figure 7:
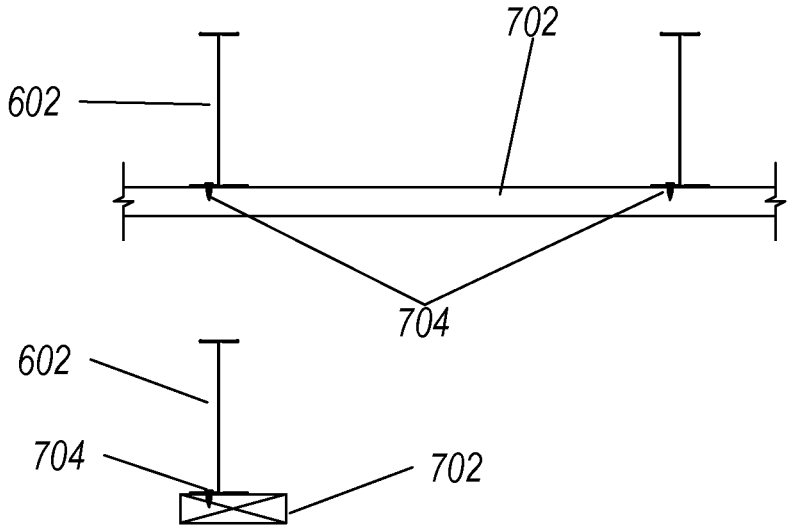
FIG. 7 illustrates an example of a sill plate attached to an I-beam.

FIG. 7 illustrates an example of a sill plate 702 attached to an I-beam 602. A sill plate 702 or sole plate in construction and architecture is the bottom horizontal member of a wall or building to which vertical members are attached. The word plate is typically omitted in America and carpenters speak simply of the "sill". Other names are ground plate, ground sill, groundsel, and mud sill. The sill plate 702 is usually composed of lumber but can be any material. The sill plate 702 typically carries the wall framing (posts and studs) and floor joists.

FIG. 7 shows that the sill plate 702 is attached to the I-beam 602 using screws 704. The screws 704 are threaded cylinders that secure the I-beam 602 relative to the sill plate 702. I.e., the screw prevents separation and lateral motion of the I-beam 602 relative to the sill plate 702. One of skill in the art will appreciate that the I-beam 602 can be attached to the sill plate 702 using any desired fastener, including bolts, rivets, adhesive, or any other desired fastener.

Figure 8A:
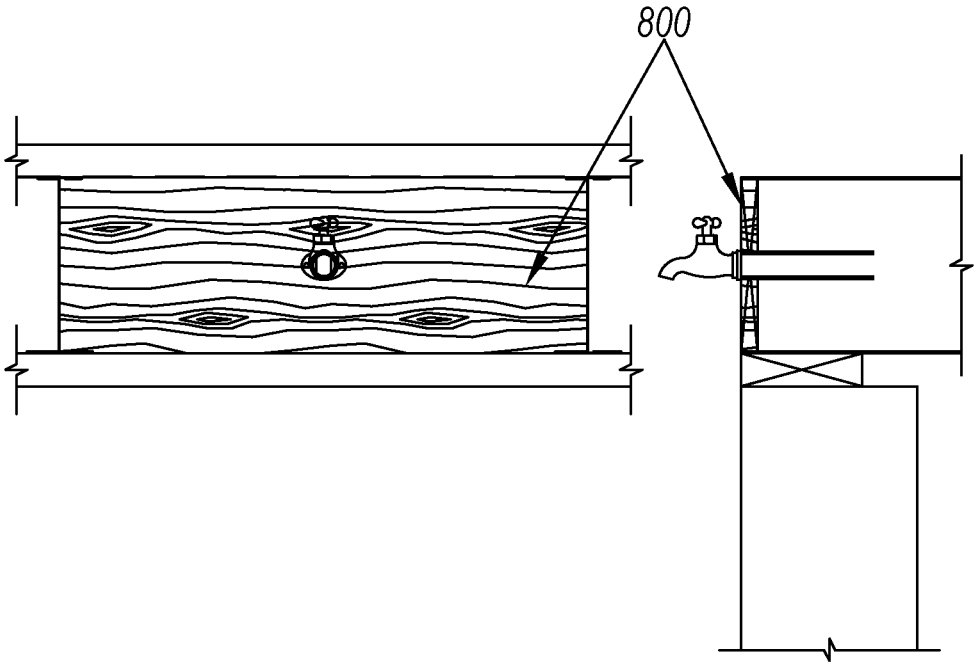
FIG. 8A illustrates an example of a backing for a hose bib.
Figure 8B:
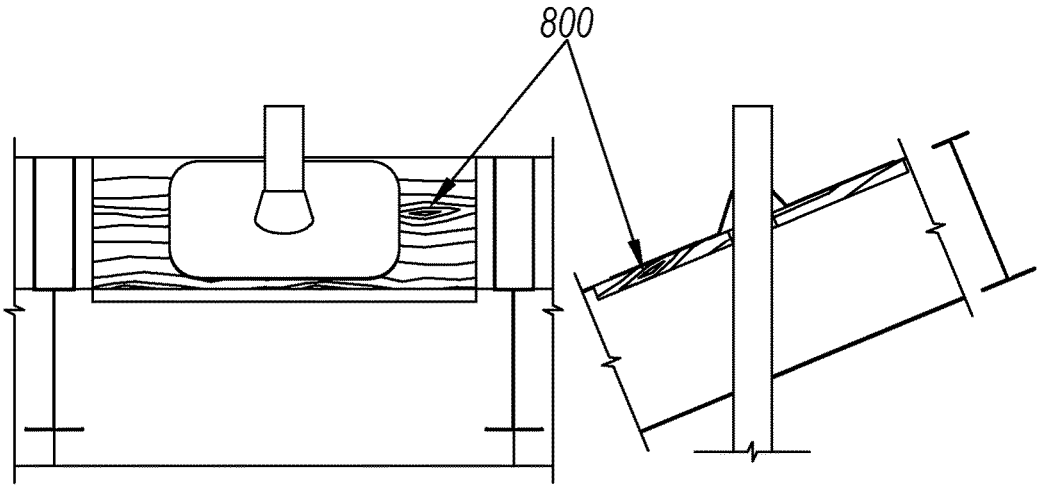
FIG. 8B illustrates an example of a backing for a roof vent.
Figure 8C:
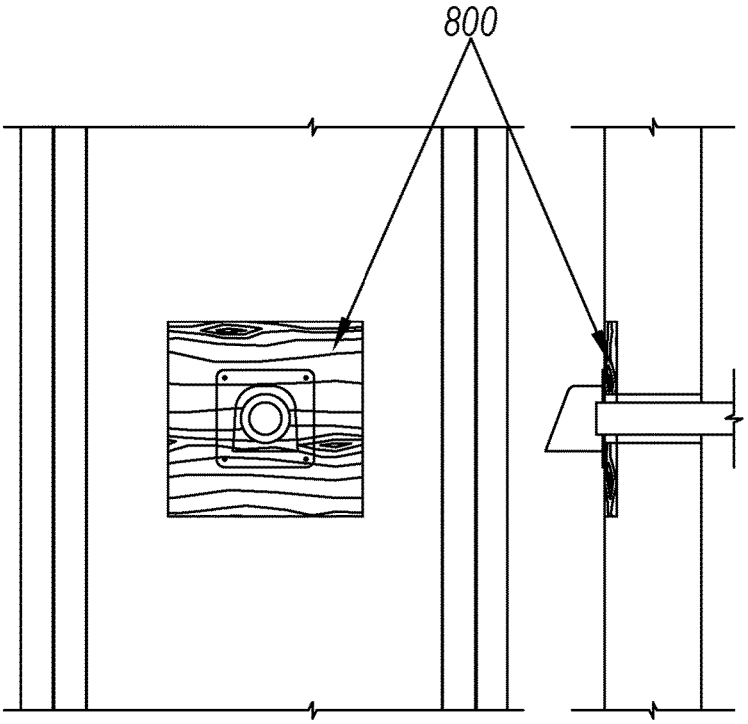
FIG. 8C illustrates an example of a backing for a wall vent.
Figure 8D:
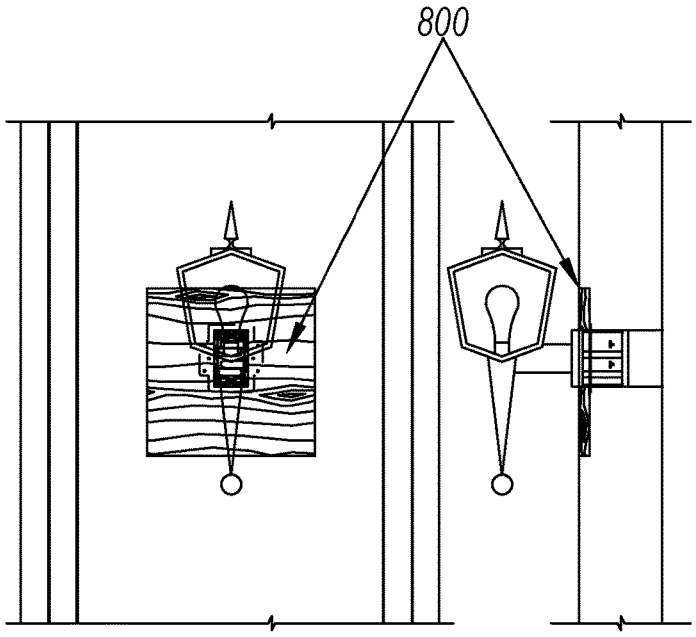
FIG. 8D illustrates an example of a backing for a light fixture.
Figure 8E:
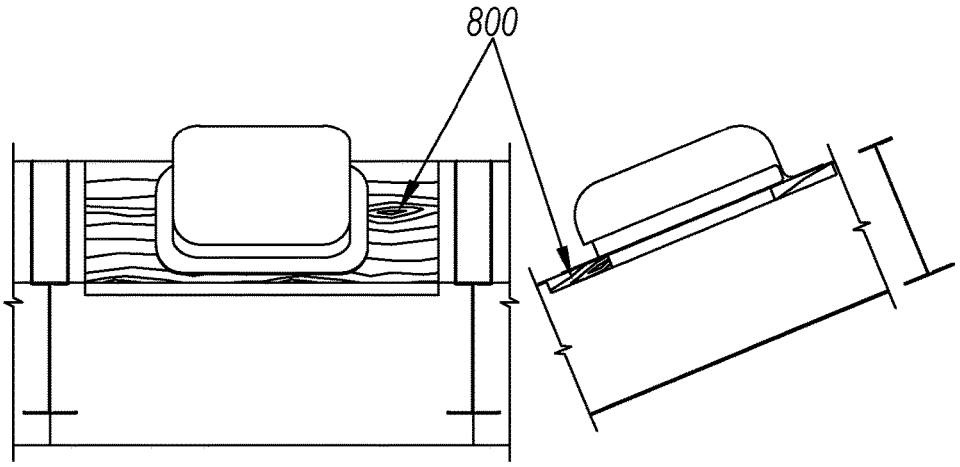
FIG. 8E illustrates an example of a backing for a turtle vent.
Figure 8F:
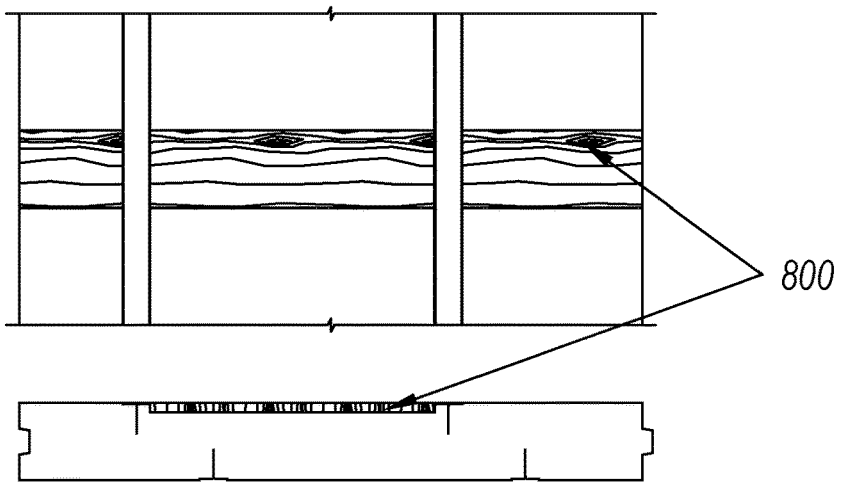
FIG. 8F illustrates an example of a backing for a cabinet.
Figure 8G:
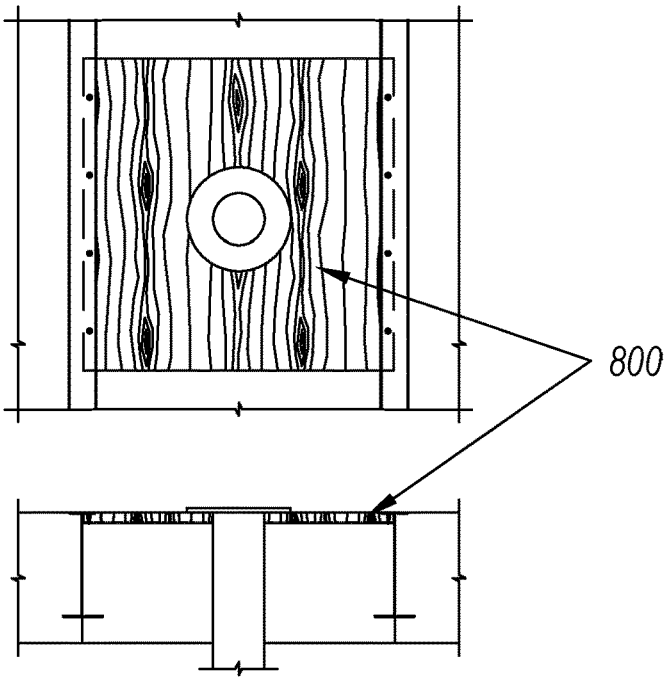
FIG. 8G illustrates an example of a backing for a toilet.
Figure 8H:
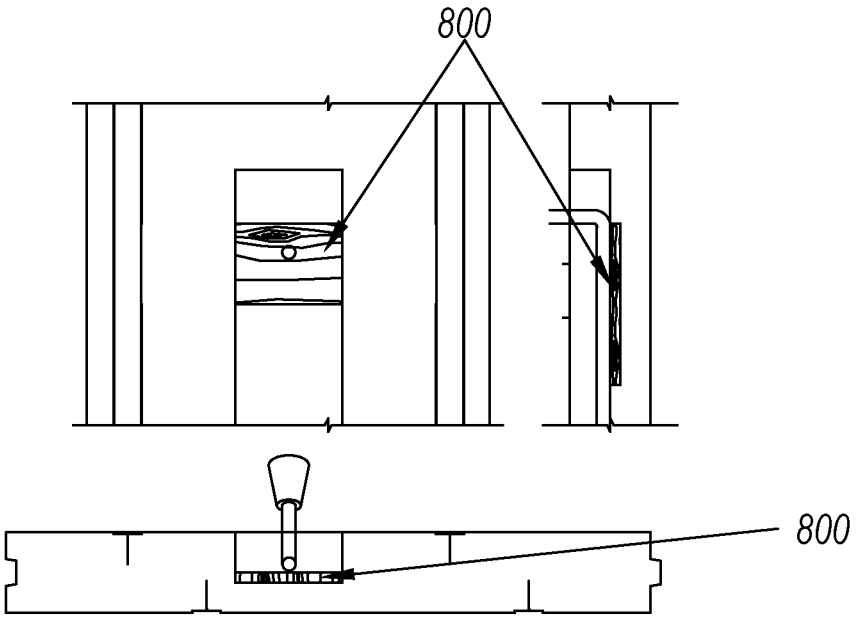
FIG. 8H illustrates an example of a backing for a shower head.
Figure 8I:
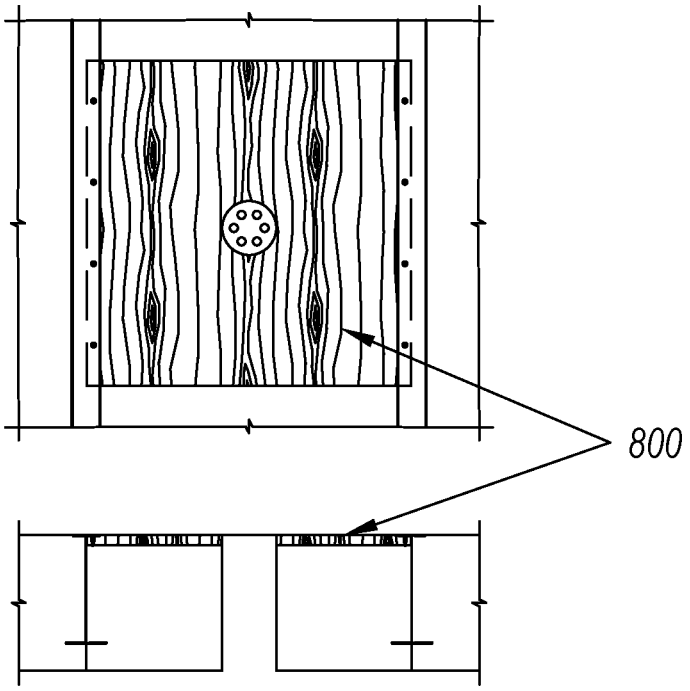
FIG. 8I illustrates an example of a backing for a floor drain.
Figure 8J:
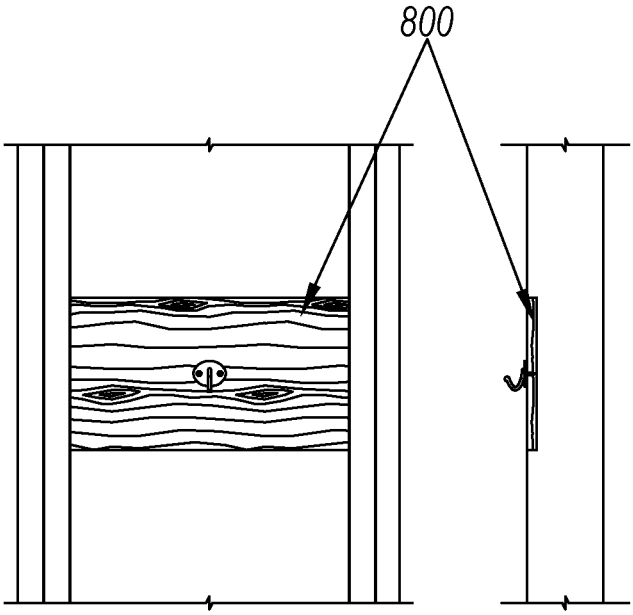
FIG. 8J illustrates an example of a backing for hardware.
Figure 8K:
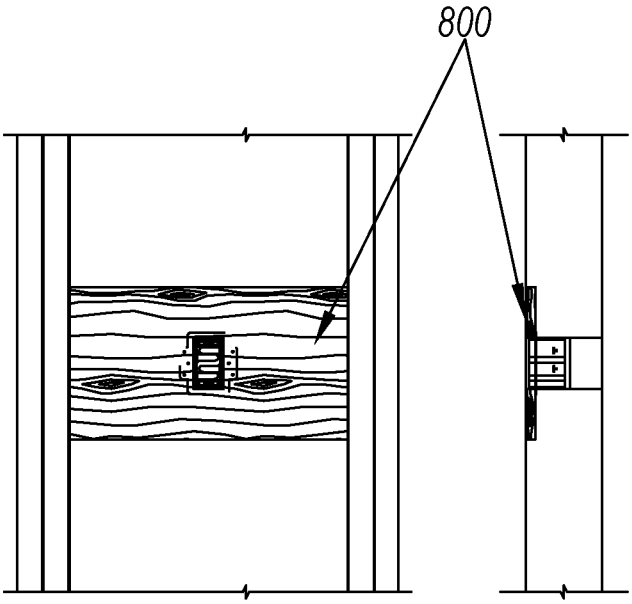
FIG. 8K illustrates an example of a backing for a light.
Figure 8L:
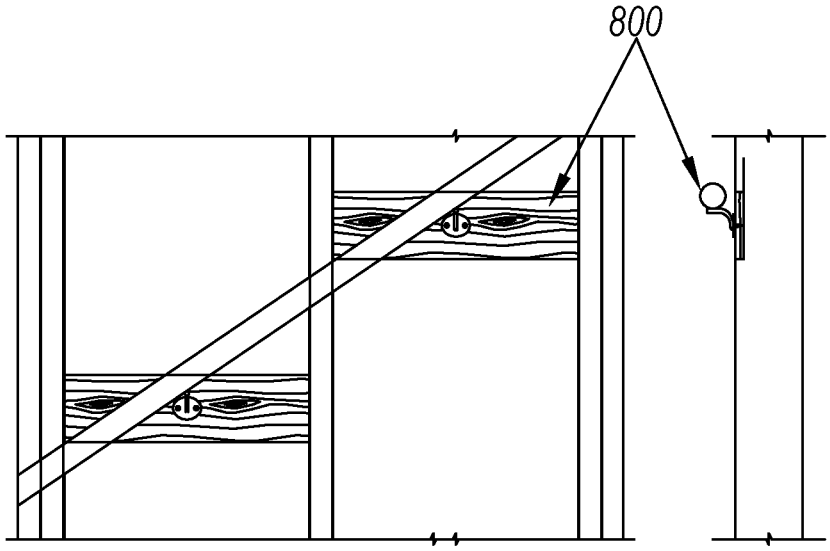
FIG. 8L illustrates an example of a backing for a hand rail.
Figure 8M:
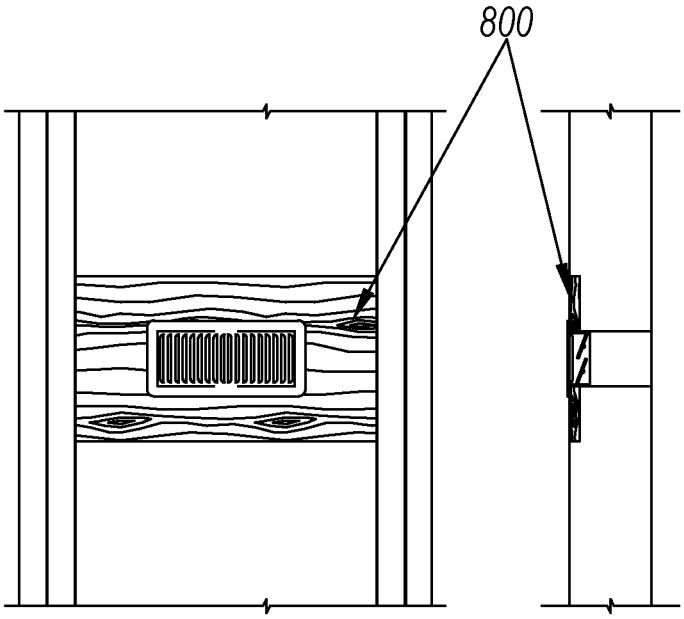
FIG. 8M illustrates an example of a backing for a heat register.
Figure 8N:
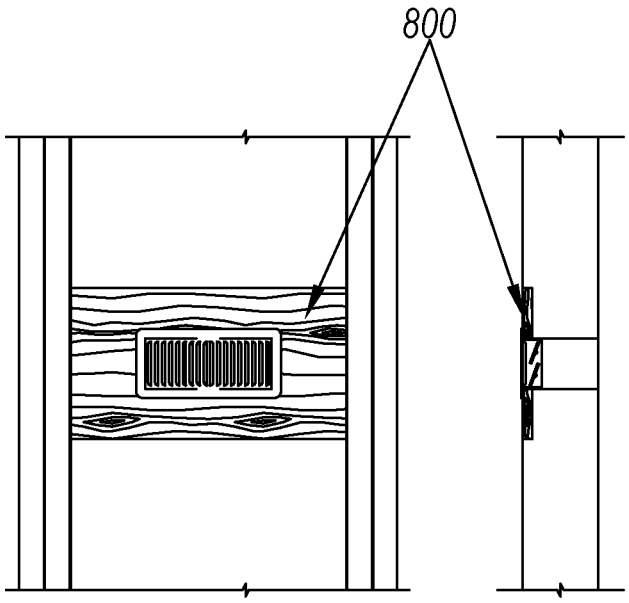
FIG. 8N illustrates an example of a backing for a return air vent.
Figure 8O:
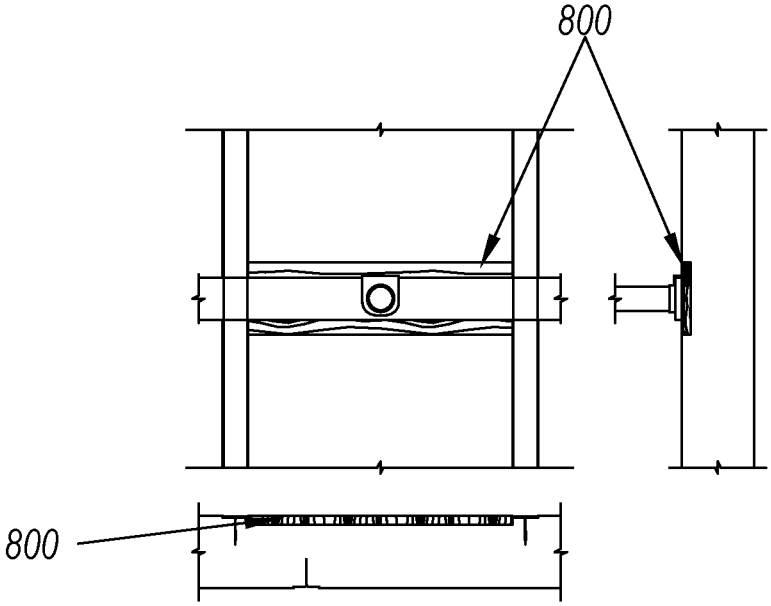
FIG. 8O illustrates an example of a backing for a closet rod.
Figure 8P:
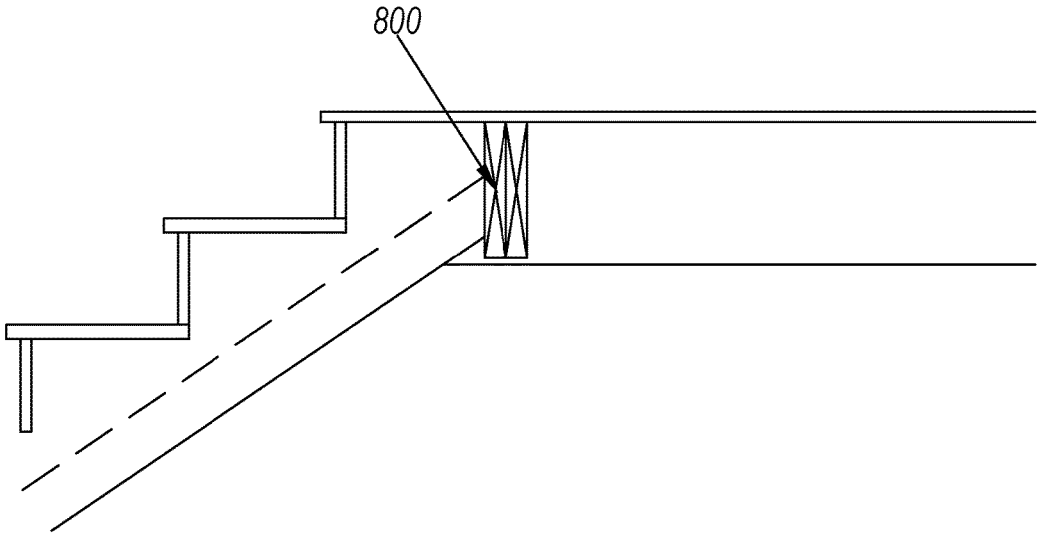
FIG. 8P illustrates an example of a backing for a stair header.

FIGS. 8A, 8B, 8C, 8D, 8E, 8F, 8G, 8H, 8I, 8J, 8K, 8L, 8M, 8N, 8O and 8P (collectively "FIG. 8") illustrate an example of a backing 800 attached to a structure with integrated insulation. FIG. 8A illustrates an example of a backing 800 for a hose bib; FIG. 8B illustrates an example of a backing 800 for a roof vent; FIG. 8C illustrates an example of a backing 800 for a wall vent; FIG. 8D illustrates an example of a backing 800 for a light fixture; FIG. 8E illustrates an example of a backing 800 for a turtle vent; FIG. 8F illustrates an example of a backing 800 for a cabinet; FIG. 8G illustrates an example of a backing 800 for a toilet; FIG. 8H illustrates an example of a backing 800 for a shower head; FIG. 8I illustrates an example of a backing 800 for a floor drain; FIG. 8J illustrates an example of a backing 800 for hardware; FIG. 8K illustrates an example of a backing 800 for a light; FIG. 8L illustrates an example of a backing 800 for a hand rail; FIG. 8M illustrates an example of a backing 800 for a heat register; FIG. 8N illustrates an example of a backing 800 for a return air vent; FIG. 8O illustrates an example of a backing 800 for a closet rod; and FIG. 8P illustrates an example of a backing 800 for a stair header. The backing 800 can include a sheet of wood or other material. The backing 800 acts as a brace or support for an external element to be mounted. The backing 800 can be secured to a building panel with integrated insulation, an I-beam, a T-beam or some combination thereof using adhesive, mechanical fasteners or any other desired attachment mechanism.

The backing 800 is secured to the structure with integrated insulation using adhesive. In particular, the adhesive is applied to the entirety of the surface of the backing 800 that is in contact with the structure with integrated insulation. This ensures that air gaps are removed, minimizing thermal bridging. Additionally or alternatively, it ensures that the backing 800 remains in place regardless of any force that would be applied by the external element.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A structure with integrated insulation, the structure with integrated insulation comprising:

a steel frame, the steel frame including:

a first vertical support beam; and a second vertical support beam;

an assembly with integrated insulation, wherein the assembly with integrated insulation:

includes a first building panel with integrated insulation, the building panel with integrated insulation including:

a first surface;

a second surface, wherein the second surface is opposite the first surface;

a first edge, wherein:

the first edge is disposed between the first surface and the second surface; and a second edge, wherein:

the second edge is disposed between the first surface and the second surface and is opposite the first edge; and the first building panel with integrated insulation being attached to the first vertical support beam on the first surface of the first building panel with integrated insulation, wherein:

no portion of the first vertical support beam passes through the second surface of the first building panel; and the attachment between the first vertical support beam and the first building panel with integrated insulation includes adhesive over an entirety of a web of the first vertical support beam in contact with the first building panel with integrated insulation;

includes a second building panel with integrated insulation, the building panel with integrated insulation including: a first surface;

a second surface, wherein the second surface is opposite the first surface;

a first edge, wherein:

the first edge is disposed between the first surface and the second surface; and a second edge, wherein:

the second edge is disposed between the first surface and the second surface and is opposite the first edge; and an indentation in the first surface configured to receive at least a portion of the first building panel with integrated insulation;

the second building panel with integrated insulation being attached to the second vertical support beam on the second surface of the second building panel with integrated insulation, wherein:

no portion of the second vertical support beam passes through the first surface of the second building panel; and the attachment between the second vertical support beam and the second building panel with integrated insulation includes adhesive over an entirety of a web of the second vertical support beam in contact with the second building panel with integrated insulation; and a joint, wherein the joint:

includes a portion of the first building panel with integrated insulation being placed within the indentation in the first surface of the second building panel with integrated insulation;

includes adhesive over an entirety of adjoining surfaces of the portion of the first building panel with integrated insulation and the indentation in the first surface of the second building panel with integrated insulation; and forms a thermal break; and a covering, wherein the covering overlays an entirety of the first surface and the first vertical support beam.

2. The structure with integrated insulation of claim 1, wherein the first building panel with integrated insulation includes a wall panel with integrated insulation.

3. The structure with integrated insulation of claim 1, wherein the first building panel with integrated insulation includes a floor panel with integrated insulation.

4. The structure with integrated insulation of claim 1, wherein the first building panel with integrated insulation includes a roof panel with integrated insulation.

5. The structure with integrated insulation of claim 1, wherein the first vertical support beam includes a T-beam.

6. The structure with integrated insulation of claim 1, wherein the first vertical support beam includes an I-beam.

7. A structure with integrated insulation, the structure with integrated insulation comprising:

a steel frame, the steel frame including:

a first vertical support beam;

a second vertical support beam;

a third vertical support beam; and a fourth vertical support beam;

an assembly with integrated insulation, wherein the assembly with integrated insulation:

includes a first building panel with integrated insulation, the building panel with integrated insulation including:

a first surface;

a second surface, wherein the second surface is opposite the first surface;

a first edge, wherein:

the first edge is disposed between the first surface and the second surface; and a second edge, wherein:

the second edge is disposed between the first surface and the second surface and is opposite the first edge;

the first building panel with integrated insulation being attached to the first vertical support beam on the first surface of the first building panel with integrated insulation, wherein:

no portion of the first vertical support beam passes through the second surface of the first building panel; and the attachment between the first vertical support beam and the first building panel with integrated insulation includes adhesive over an entirety of a web of the first vertical support beam in contact with the first building panel with integrated insulation;

the first building panel with integrated insulation being attached to the second vertical support beam on the second surface of the first building panel with integrated insulation, wherein:

no portion of the second vertical support beam passes through the first surface of the first building panel; and the attachment between the second vertical support beam and the first building panel with integrated insulation includes adhesive over an entirety of a web of the second vertical support beam in contact with the first building panel with integrated insulation;

includes a second building panel with integrated insulation, the building panel with integrated insulation including:

a first surface;

a second surface, wherein the second surface is opposite the first surface;

a first edge, wherein:

the first edge is disposed between the first surface and the second surface; and a second edge, wherein:

the second edge is disposed between the first surface and the second surface and is opposite the first edge; and an indentation in the first surface;

a c-channel attached within the indentation, wherein the c-channel is configured receive the first edge of the first building panel with integrated insulation;

wherein the c-channel includes adhesive on an entire surface of the c-channel in contact with the second building panel with integrated insulation forming a thermal break; and a joint, wherein the joint:

includes the first edge of the first building panel with integrated insulation being placed within the c-channel;

includes adhesive over an entirety of adjoining surfaces of the first edge of the first building panel with integrated insulation and the c-channel; and forms a thermal break;

the second building panel with integrated insulation being attached to the third vertical support beam on the first surface of the second building panel with integrated insulation, wherein:

no portion of the third vertical support beam passes through the second surface of the second building panel; and the attachment between the third vertical support beam and the second building panel with integrated insulation includes adhesive over an entirety of a web of the third vertical support beam in contact with the second building panel with integrated insulation;

the second building panel with integrated insulation being attached to the fourth vertical support beam on the second surface of the second building panel with integrated insulation, wherein:

no portion of the fourth vertical support beam passes through the first surface of the second building panel; and the attachment between the fourth vertical support beam and the second building panel with integrated insulation includes adhesive over an entirety of a web of the fourth vertical support beam in contact with the second building panel with integrated insulation.

8. The structure with integrated insulation of claim 7, wherein the c-channel is attached to the third vertical support beam.

9. The structure with integrated insulation of claim 7 further comprising an adhesive, wherein the adhesive covers an entire surface of the c-channel in contact with the first building panel with integrated insulation.

10. The structure with integrated insulation of claim 7, wherein the c-channel is approximately 4 inches wide and 1.5 inches high.

11. The structure with integrated insulation of claim 7, wherein the c-channel is approximately 6 inches wide and 1.5 inches high.

12. The structure with integrated insulation of claim 7, wherein the c-channel includes a c-channel junction.

13. The structure with integrated insulation of claim 7, wherein the c-channel is angled to match the pitch of a roof.

14. The structure with integrated insulation of claim 7 wherein the width of the c-channel is:

$$w_1 = w \times \sqrt{1+p^2}$$

where:

$w_1$ is the width of the c-channel w is the width of the first building panel with integrated insulation; and p is the pitch of the roof.

15. A structure with integrated insulation, the structure with integrated insulation comprising:

a steel frame, the steel frame including:

a first vertical support beam;

a second vertical support beam;

a third vertical support beam;

a fourth vertical support beam; and a post;

an assembly with integrated insulation, wherein the assembly with integrated insulation:

includes a first building panel with integrated insulation, the building panel with integrated insulation including:

a first surface; a second surface, wherein the second surface is opposite the first surface;

a first edge, wherein:

the first edge is disposed between the first surface and the second surface; and a second edge, wherein:

the second edge is disposed between the first surface and the second surface and is opposite the first edge; and a river configured to allow for the placement of a utility line within the wall panel with integrated insulation;

the first building panel with integrated insulation being attached to the first vertical support beam on the first surface of the first building panel with integrated insulation, wherein:

no portion of the first vertical support beam passes through the second surface of the first building panel; and the attachment between the first vertical support beam and the first building panel with integrated insulation:

includes adhesive over an entirety of a web of the first vertical support beam in contact with the first building panel with integrated insulation; and creates a thermal break;

the first building panel with integrated insulation being attached to the second vertical support beam on the second surface of the first building panel with integrated insulation, wherein:

no portion of the second vertical support beam passes through the first surface of the first building panel; and the attachment between the second vertical support beam and the first building panel with integrated insulation:

includes adhesive over an entirety of a web of the second vertical support beam in contact with the first building panel with integrated insulation; and creates a thermal break;

includes a second building panel with integrated insulation, the building panel with integrated insulation including:

a first surface;

a second surface, wherein the second surface is opposite the first surface; a first edge, wherein:

the first edge is disposed between the first surface and the second surface; and a second edge, wherein:

the second edge is disposed between the first surface and the second surface and is opposite the first edge; and an indentation in the first surface configured to receive at least a portion of the first building panel with integrated insulation;

a joint, wherein the joint:

adjincludes the first edge of the first building panel with integrated insulation being placed within the indentation in the first surface of the second building panel with integrated insulation;

includes adhesive over an entirety of adjoining surfaces of the first edge of the first building panel with integrated insulation and the indentation in the first surface of the second building panel with integrated insulation; and creates a thermal break;

the second building panel with integrated insulation being attached to the third vertical support beam on the first surface of the second building panel with integrated insulation, wherein:

no portion of the third vertical support beam passes through the second surface of the second building panel; and the attachment between the third vertical support beam and the second building panel with integrated insulation:

includes adhesive over an entirety of a web of the third vertical support beam in contact with the second building panel with integrated insulation; and creates a thermal break;

the second building panel with integrated insulation being attached to the fourth vertical support beam on the second surface of the second building panel with integrated insulation, wherein:

no portion of the fourth vertical support beam passes through the first surface of the second building panel; and the attachment between the fourth vertical support beam and the second building panel with integrated insulation:

includes adhesive over an entirety of a web of the fourth vertical support beam in contact with the second building panel with integrated insulation; and creates a thermal break;

a backing secured within the second building panel with integrated insulation, the backing configured to allow an external device to be attached to the second building panel with integrated insulation; and a panel connection, the panel connection configured to attach the second edge of the second building panel with integrated insulation to the post.

16. The structure with integrated insulation of claim 15, wherein the backing includes a board.

17. The structure with integrated insulation of claim 15, wherein the backing is attached to the second vertical support beam.

18. The structure with integrated insulation of claim 15, wherein the backing is glued to the second building panel with integrated insulation.

19. The structure with integrated insulation of claim 15, wherein the backing is flush with the first surface of the second building panel with integrated insulation.

20. The structure with integrated insulation of claim 15, wherein the backing is recessed relative to the first surface of the second building panel with integrated insulation.

* * * * *